US005542541A

United States Patent [19]

Smith

[11] Patent Number: 5,542,541

[45] Date of Patent: Aug. 6, 1996

[54] MULTI-SIDED COLLAPSIBLE CONTAINER

[75] Inventor: Glenn M. Smith, Burton, Mich.

[73] Assignee: Four M Manufacturing Group of CPC, Inc., Flint, Mich.

[21] Appl. No.: 299,215

[22] Filed: Aug. 31, 1994

[51] Int. Cl.[6] ..... B65D 90/16; B65D 19/06

[52] U.S. Cl. ..... 206/600; 229/109; 229/117.06

[58] Field of Search ..... 206/386, 600; 229/109, 117.05, 117.06

[56] References Cited

U.S. PATENT DOCUMENTS

| | | | |
|---|---|---|---|
| 3,026,015 | 3/1962 | Severn . | |
| 3,519,190 | 7/1970 | Achermann et al. . | |
| 3,708,861 | 1/1973 | Hickey . | |
| 3,743,166 | 7/1973 | Heavner . | |
| 3,756,498 | 9/1973 | Anderson . | |
| 3,831,744 | 8/1974 | Walden et al. . | |
| 3,949,874 | 4/1976 | Heavner . | |
| 3,949,929 | 4/1976 | Kupersmit . | |
| 4,009,787 | 3/1977 | Beal . | |
| 4,085,846 | 4/1978 | Williams . | |
| 4,085,847 | 4/1978 | Jacalone . | |
| 4,089,417 | 5/1978 | Osborne . | |
| 4,094,458 | 6/1978 | Nelson, Jr. | 229/117.0 |
| 4,119,205 | 10/1978 | Delany . | |
| 4,230,227 | 10/1980 | Kowall et al. . | |
| 4,350,099 | 9/1982 | Persson . | |
| 4,373,637 | 2/1983 | Shippell . | |
| 4,383,609 | 5/1983 | Lochmiller . | |
| 4,392,606 | 7/1983 | Fremion . | |
| 4,445,614 | 5/1984 | Mitsumori et al. . | |
| 4,454,946 | 1/1984 | Yokowo . | |
| 4,503,973 | 3/1985 | Anderson . | |
| 4,606,461 | 8/1986 | Bolton, Sr. . | |
| 4,676,373 | 6/1987 | Schneider . | |
| 4,694,962 | 9/1987 | Taub . | |
| 4,697,699 | 10/1987 | Schneider . | |
| 4,712,687 | 12/1987 | Silcott et al. . | |
| 4,756,469 | 7/1988 | Hansen . | |
| 4,760,922 | 8/1988 | Northgrave . | |
| 4,763,787 | 8/1988 | Koenig . | |
| 4,771,939 | 9/1988 | Wilkins . | |
| 4,776,481 | 10/1988 | Kidd . | |
| 4,793,507 | 12/1988 | Delplanque . | |
| 4,798,294 | 1/1989 | Bodi . | |
| 4,809,851 | 3/1989 | Oestreich, Jr. et al. . | |
| 4,817,824 | 4/1989 | LeFleur et al. . | |
| 4,830,191 | 5/1989 | Dijksman . | |
| 4,860,912 | 8/1989 | Kupersmit . | |
| 5,318,219 | 6/1994 | Smith | 206/600 |

*Primary Examiner*—Jimmy G. Foster
*Attorney, Agent, or Firm*—Brooks & Kushman

[57] ABSTRACT

A multi-sided collapsible container is provided in combination with a pallet. The container preferably has an octagonal shape. The upright portion of the container is formed from a plurality of side panels, end panels, and corner panels. A bottom to the container is formed from a combination of bottom flaps and floor panels. Floor panels are affixed to the pallet for securing the container thereto. A plurality of transverse fold lines in combination with a plurality of lateral fold lines enable the container to move between an open upright use position and a plurality of collapsed storage positions contained within the confines of the pallet.

10 Claims, 3 Drawing Sheets

MULTI-SIDED COLLAPSIBLE CONTAINER

TECHNICAL FIELD

This invention relates to a multi-sided collapsible container which is designed to be mounted to a pallet, and particularly to an octagonal-shaped collapsible container which is designed to collapse and be folded in a flattened configuration on the pallet and within its dimensions for transport and storage.

BACKGROUND OF THE INVENTION

It has been common practice in certain manufacturing practices to utilize containers manufactured from corrugated paper or fiberboard and which are mounted on a pallet. The pallets are generally manufactured of wood or corrugated fiberboard and are designed to enable forklifts to approach them from various directions to quickly and easily move them from one site to another.

Originally, such assemblies were formed from two separate units including an assembled carton and a pallet. The container was constructed prior to mounting them on the pallet for use. Significant amounts of storage area were required if the containers were stored for reuse.

Collapsible containers for use with a pallet were designed to overcome this problem. Initial attempts included containers that had side walls or end walls which were collapsible while the entire bottom of the container was either totally affixed to the pallet or completely removable therefrom. An example of a patent which has its entire bottom attached to the pallet is disclosed in U.S. Pat. No. 4,085,846 to Williams. That patent discloses a floorless container which relies on a floor form which is separate and attached to a standardized pallet. In this configuration, the container does not provide for the requisite support and the side walls can separate from the floor resulting in a weakened container.

An alternative approach has been to provide a container and pallet both being made from corrugated fiberboard or the like where the pallet can be formed from the same material as the container. Examples of such an approach may be seen in U.S. Pat. Nos. 4,445,614 to Mitsumori, et al, 4,119,205 to Delany, 3,743,166 to Heavner, 3,519,190 to Achermann, et al, and 3,026,015 to Severn. Some of these patents illustrate a container having a pallet integrally formed with the container and able to be knocked down and folded for storage. A disadvantage of these containers which have a pallet as part thereof is that they require a significant amount of assembly time and frequently more than one person to assemble. Such configurations severely lessen their desirability for use and have an additional problem in that some may be approached with a forklift only from certain directions.

Alternative designs were developed to secure a portion of the bottom panel of the container to the pallet enabling the container to collapse onto the fixed bottom panel for storage and transportation. U.S. Pat. No. 4,760,922 to Northgrave, U.S. Pat. No. 4,712,687 to Silcott, et al, U.S. Pat. No. 4,606,461 to Bolton, Sr. and U.S. Pat. No. 4,373,637 to Shippell are examples of this approach. If the collapsed containers project outwardly beyond the periphery of the pallet or do not collapse flat generally parallel to the pallet, potential damage could result to the container during transportation and storage, the products would take up additional floor space during transport and storage, and the products would not stock well beyond a certain height.

To reduce the potential for damage, the Silcott, et al container is configured to remain within the periphery of the pallet within its collapsed state. However, a bulky silhouette results from such a configuration. Bolton provides a rigid tray which is secured to the pallet and forms a holder in which the remainder of the container is positioned and collapsed. An additional cover or lid is provided which is seated over the collapsed container and protects it from damage during transportation or storage.

Collapsible containers are inherently weaker than conventional aluminum or wooden containers of similar size and structure. Numerous attempts have been made to reinforce conventional corrugated fiberboard containers to overcome this deficiency. U.S. Pat. Nos. 4,230,227 to Kowall, et al and 3,949,874 to Heavner provide wooden reinforcements in an attempt to strengthen the container construction. Reinforced containers also allow more containers and more weight to be stacked on them without damage. An alternative approach disclosed in U.S. Pat. No. 4,383,609 to Lochmiller which provides a multi-piece container including locking sections which are used to reinforce the side walls of the container. U.S. Pat. Nos. 4,089,417 to Osborn relies on an inner liner of corrugated fiberboard to achieve additional rigidity and strength, and does not fold or collapse into a single structure on a pallet. Such constructions, make collapsing and folding of the container difficult while adding to the height and weight of the container in its collapsed state.

The present invention incorporates many of the known benefits of collapsible containers but is an improvement in terms of strength, use, storage capabilities and general configuration.

SUMMARY OF THE INVENTION

A collapsible container is provided in combination with a pallet. An octagonal container is provided which is movable between a collapsed position and a use position. The container is formed from two opposed side panels, each having a floor panel integrally and foldably connected thereto. Two opposed end panels are provided, each having a bottom flap integrally and foldably connected thereto. Four corner panels are provided, respectively joining the side panels to a respective end panel. A first lateral fold line separates each end panel from each bottom flap. The first lateral fold line enables each bottom flap to selectively pivot between a use position adjacent the pallet in general perpendicular alignment with each floor panel and a storage position contiguous with a respective one of the end panels. Each bottom flap is adapted to bridge a distance between its respective end panel and the floor panel when in the use position. A first transverse fold line is provided which bisects each end panel and its respective bottom flap enabling movement of each end panel and its respective bottom flap from the storage position to the use position. This is possible when the respective bottom flap bridges the distance between its respective end panel and the floor panel to oppose movement of the end panels toward the storage position.

A plurality of second transverse fold lines are juxtaposed between each of the end panels and the side panels. The side panels and the corner panels enable formation of an octagonal configuration of the container as the container moves from the storage position to the use position. A plurality of second lateral fold lines are provided which are juxtaposed between each side panel and its respective floor panel enabling the floor panels to be oriented adjacent the pallet and affixed thereto when the container is in the use position. The second horizontal fold line is provided and facilitates folding of the container to the storage position.

The floor panels each contain a plurality of third lateral fold lines, which, in combination with the first transverse fold lines, the second transverse fold lines, the first lateral fold lines and the second lateral fold lines, enable collapsing movement of the container between the use position and the storage position.

Accordingly, it is an object of the present invention to provide an octagon configured container which is collapsibly mounted to a pallet.

A further object of the present invention is to provide a collapsible container having sufficient rigidity to be utilized with heavy materials.

A still further object of the present invention is to provide an unreinforced collapsible fiberboard container which has additional rigidity and strength to allow the stacking of more containers and weight on top of it then with known unreinforced collapsible fiberboard containers.

An additional object of the present invention is to provide a collapsed container having an octagonal shape which is maintained within the boundaries of the pallet in both the use position and the storage position.

Yet another object of the present invention is to provide an octagonally-shaped collapsible container having a plurality of storage positions.

Still another object of the present invention is to provide a collapsible container in combination with a pallet having sufficient rigidity to minimize bulging out of side panels in the use position.

An advantage of the present invention is to provide a rigid container in combination with a pallet which is collapsibly storable thereon.

A further advantage of the present invention is to provide a collapsible container having an octagonal shape which has a low profile when in the storage position.

A specific object of the present invention is to provide a selectively collapsible palletized container having a substantially rigid pallet. A fold-up container is provided which is movable between an open upright use position and a pair of collapsed storage positions on the pallet. The fold-up container has a circumscribing wall portion and first and second pairs of opposing base portions. The first pair of base portions connect the fold-up container to the pallet and are foldable with respect to the circumscribing wall portions. The first pair of base portions also provide support to the pallet when the wall portions are upright with respect to the pallet. The second pair of base portions form a bridge between the first pair of base portions and the wall portions to open the wall portions, with respect to the pallet, into their upright use position. The second pair of base portions are foldable with respect to the wall portions and with the wall portions while the first pair is foldable with respect to itself and the wall portions to permit the collapse of the fold-up container into either of a pair of storage positions.

The above objects, features, and advantages of the present invention are readily apparent from the following detailed description of the best mode for carrying out the invention when taken in connection with the accompanying drawings.

BEST MODE FOR CARRYING OUT THE INVENTION

Figure 1:
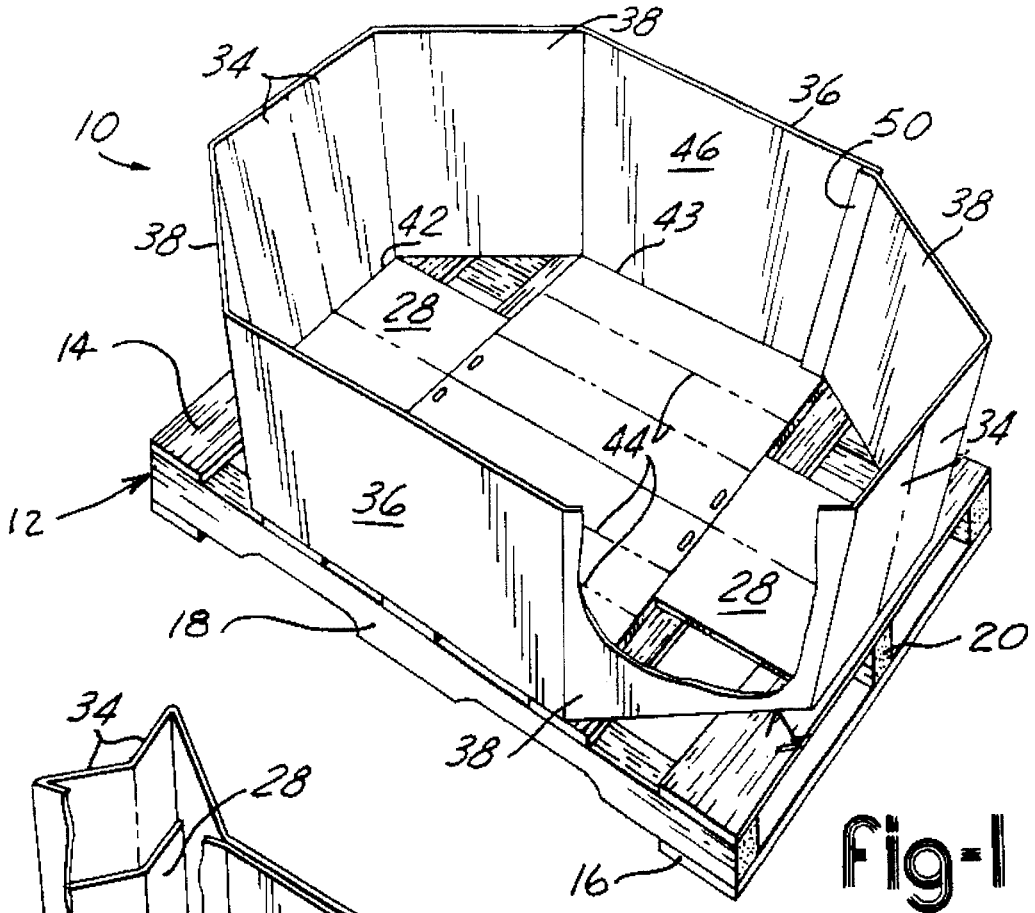
FIG. 1 is a perspective view of the collapsible container in its upright use position.

The embodiment shown in FIGS. 1 through 6 illustrates a collapsible container 10 formed in combination with a pallet 12. The generally rectangular pallet 12 is of conventional design having a top 14, a bottom 16 and a first side 18 and a second side 20. Although wood is the preferred material to manufacture the pallet 12, other materials capable of providing the required rigidity and durability are acceptable alternatives, such as folded corrugated fiberboard.

The container 10 shown in FIGS. 1–6 is constructed from corrugated paper material which is one-ply thick. Two-ply and three-ply corrugated paper may also be utilized according to the principles of present invention. However, use of a thicker ply paper will result in more difficulty in folding or collapsing the container as well as obtaining a thicker silhouette when the container is collapsed or in the storage position.

As shown in FIG. 1, the container 10 has an octagonal configuration. This configuration increases the stability of the container 10 when used with heavy items and prevents the sides of the container 10 from "bulging out". The additional stability provided by an eight-sided container with eight vertical folds compared with a four-sided container with four vertical folds increases the strength of the container when others are stacked on top of it. An octagon-sided container thus allows additional weight or additional containers to be stacked on it when compared with a four-sided container of similar size, material and capacity.

Figure 6:
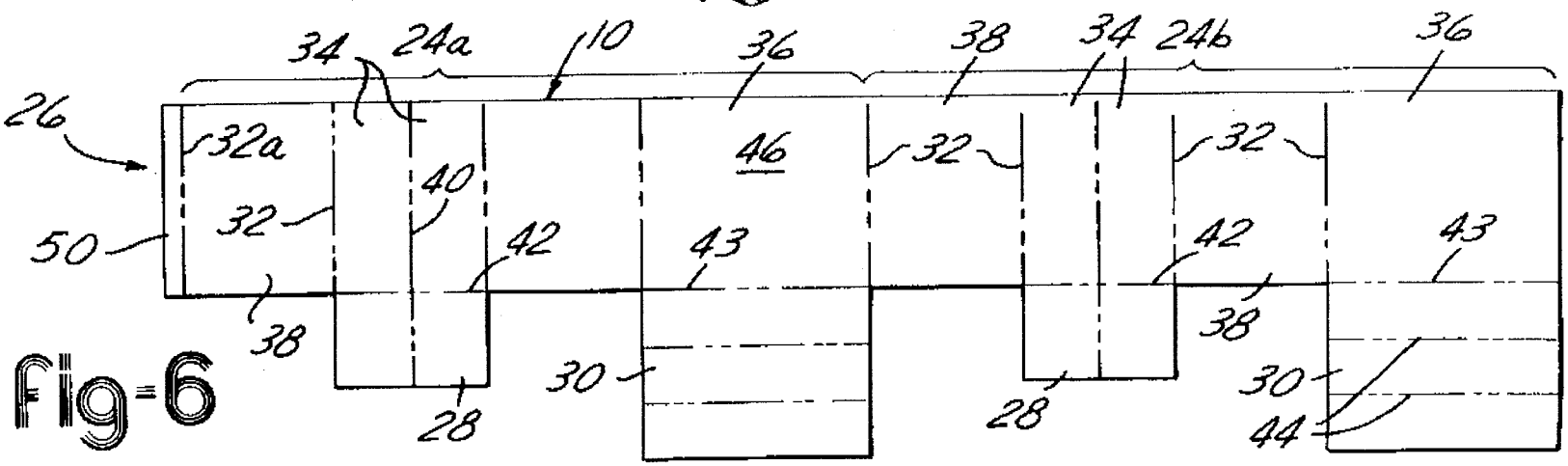
FIG. 6 is a plan view of a foldable blank in accordance with the present invention.

As shown in FIG. 6, the container 10 is formed from a single foldable blank 22. The blank 22 has two substantially similar halves *24a* and *24b*. Each half of the blank 22 is formed from a lateral portion 26 and two transverse portions, respectively a bottom flap 28 and a floor panel 30. The bottom flap 28 and the floor panel 30 each project below the lateral portion 26 of the blank 22 and generally perpendicular thereto.

The lateral portion 26 forms the side walls sides of the container 10. A first series of transverse score or fold lines 32 enable the lateral portion 26 to be folded in a controlled fashion ensuring the desired configuration in both the use position and the storage position. The first series of transverse fold lines 32 separate the lateral portion into end panels 34, side panels 36 and corner panels 38. As shown in FIG. 1, the desired configuration for the container 10 in the use position is an octagon. As may be seen in FIG. 6, the first series of transverse fold lines 32 separate the lateral portion 26 of the blank 22 into two side panels 36, two end panels 38 and four corner panels 34. A second series of the transverse fold lines 40 bisect respective end panels 34 and bottom flaps 28, enabling the end panel 34 and bottom flap 28 to be collapsed.

Figure 2:
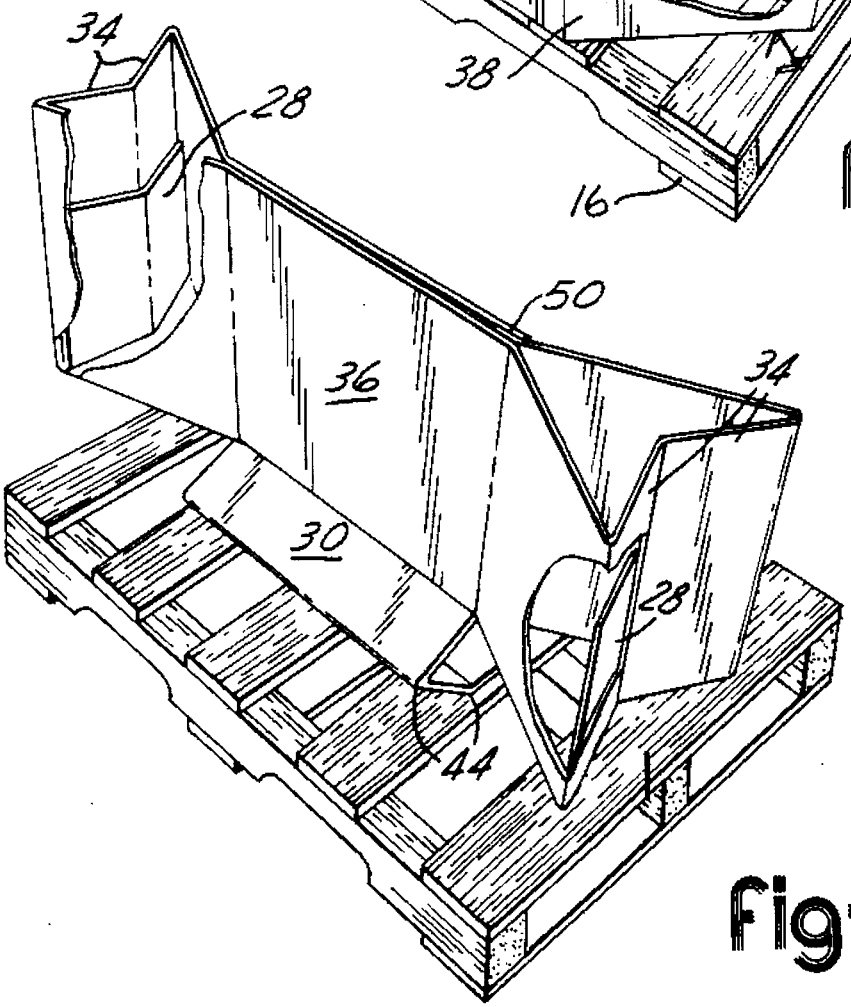
FIG. 2 is a perspective view of the container showing the container in a partially collapsed upright position.
Figure 3:
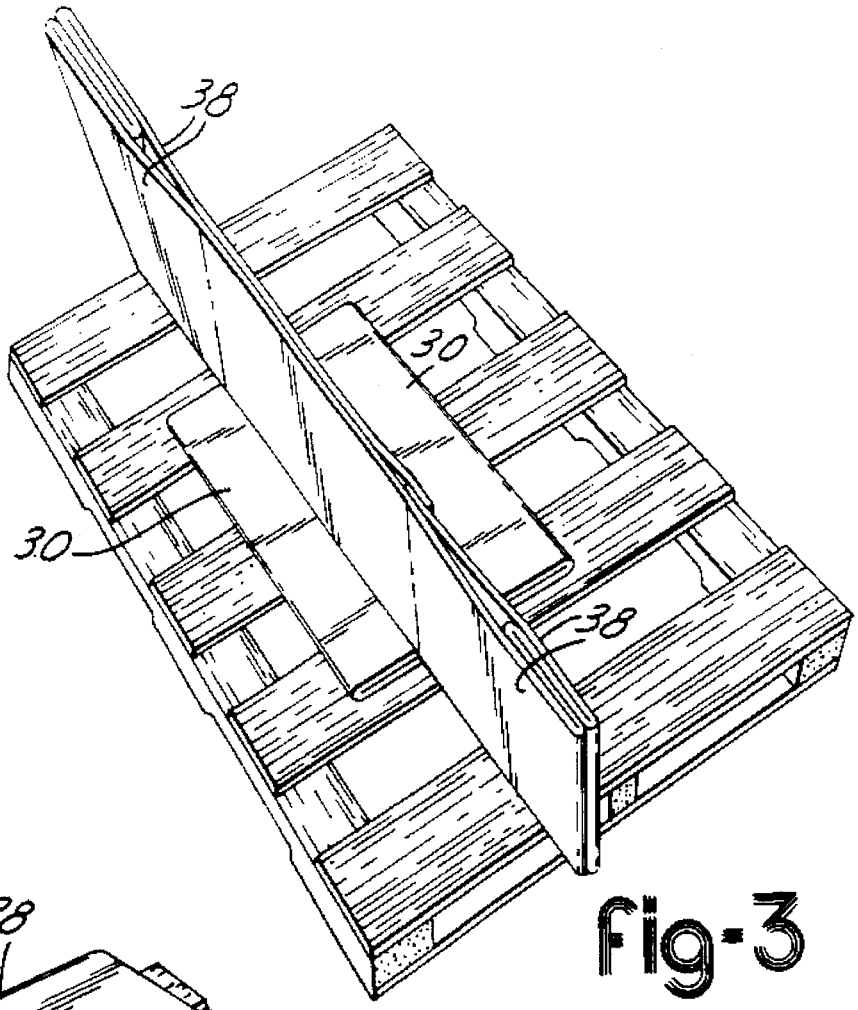
FIG. 3 is a perspective view of the container in a collapsed normal distension position.
Figure 4:
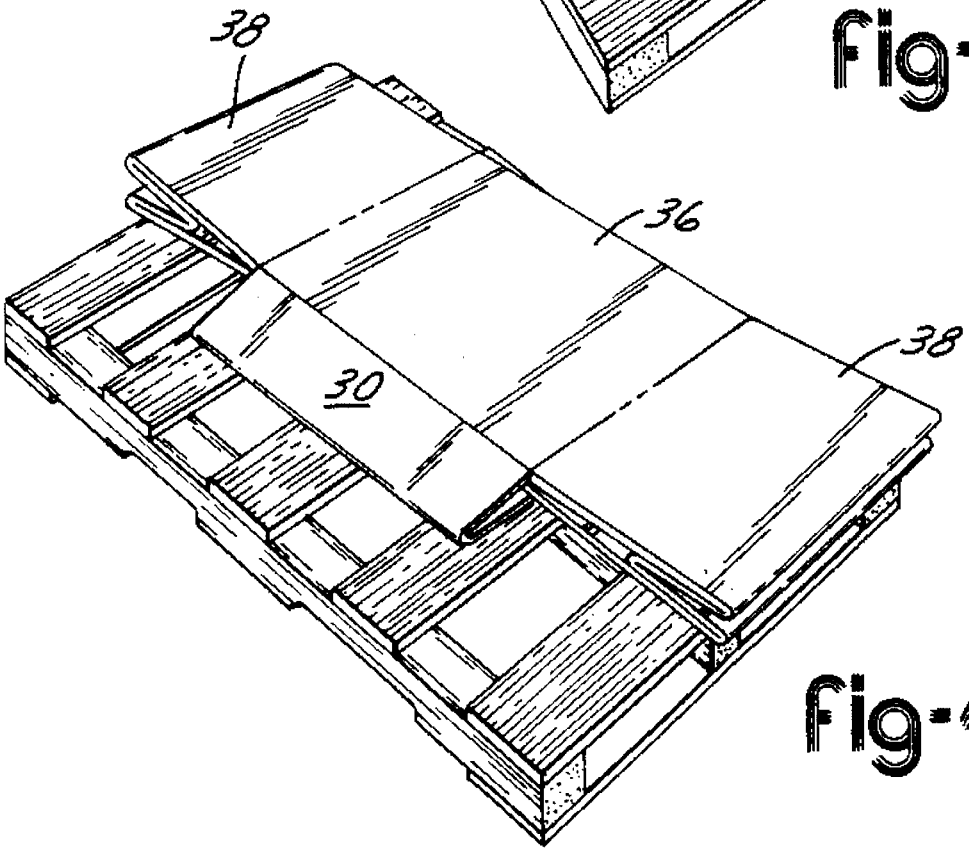
FIG. 4 is a perspective view of the container affixed to a pallet showing a collapsed container in its first storage position.
Figure 5:
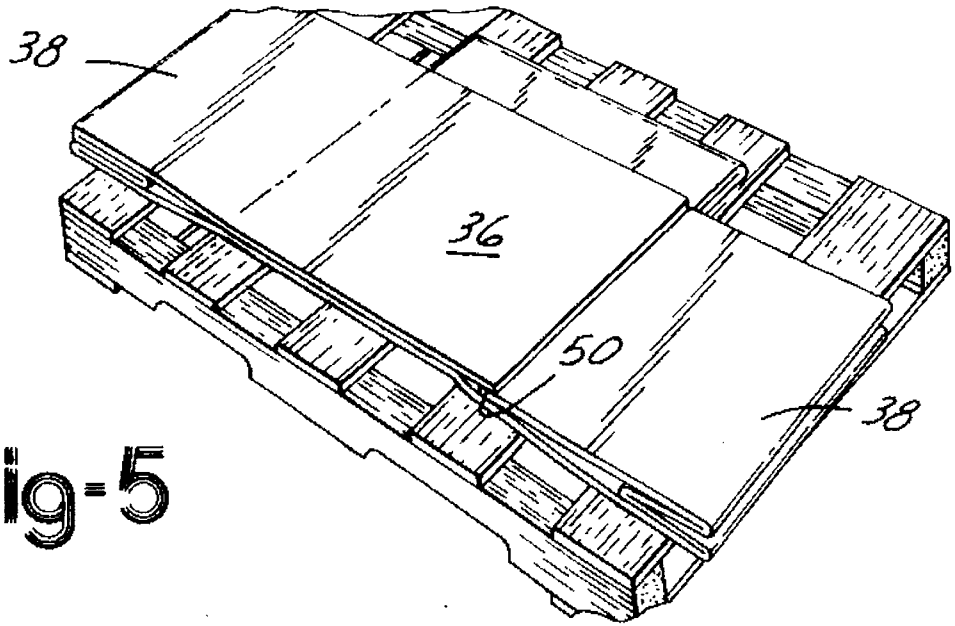
FIG. 5 is a perspective view of the container affixed to a pallet showing a collapsed container in its second storage position.

A first series of lateral fold lines 42 are juxtaposed between the lateral portion 26 and each respective bottom flap 28 enabling each respective bottom flap 28 to be foldable relative to the lateral portion 26. A second series of lateral fold lines 43 juxtaposed between the lateral portion 26 and the respective floor panels 30 enable each floor panel 30 to fold in two directions. This folding of the bottom flap 28 and the floor panel 30 relative to the lateral portion 26 is best shown in FIG. 1. A third series of lateral fold lines 44 equally divide each floor panel into thirds. The combination of the first series of lateral fold lines 42, the second series of lateral fold lines 43 and the third series of lateral fold lines 44, as shown in FIGS. 2 through 4, enable the container 10 to collapse or fold into its storage positions.

As shown in FIG. 6, the corner panels 38 and the end panels 34 have the same outer dimensions. The side panels 36 have the same size in the transverse direction as the corner panels 38 and the end panels 34 but are twice as large relative thereto in the lateral direction. The bottom flaps 28 are approximately two-thirds the size of the floor panels 30. The first series of transverse fold lines 32 and the second series of the transverse fold lines 40 are parallel with each other. The first series of lateral fold lines 42, and second series of lateral fold lines 43 are in line with one another, and both are parallel to the third series of lateral fold lines 44.

As shown in FIGS. 1 through 5, the container 10 is movable between a plurality of collapsed storage positions and an open, upright use position. For ease of reference, all elements of the container 10 as shown in the blank 22 in FIGS. 1–6, have an inner surface 46 and an outer surface 48.

To form the container 10 in combination with the pallet 12, the blank 22 is folded inwardly toward the inner surface 46, along each of the first series of transverse fold lines 32. Each floor panel 30 is then folded along the second series of lateral fold lines 43, inwardly relative its respective side panel 36 at an angle of approximately 90°. The side panel 36 which is located at an end of the lateral portion 26 is then folded inwardly to place each floor panel 30 in opposed relation relative the other floor panel 30. Each bottom flap 28 is folded inwardly along the first series of lateral fold lines 42 relative its respective end panel 34 to an angle of approximately 90°. At this point, the blank 22 is placed on the pallet 12 such that the floor panels 30 are centrally located along the first side 18 to ensure that the container 10 will be maintained within the boundaries of the pallet 10 in the use position and storage positions.

The two floor panels 30 are abutted adjacent one another (see FIG. 1) and each floor panel 30 is affixed to the pallet 12 by means of staples or the like. In this manner, the floor panels 30 remain in fixed opposed relation relative to each other. The folding of the first series of transverse fold lines 32 adjacent the panels 34, 36 and 38 allows the blank to form an octagonal configuration. The last of the first series of transverse fold lines **32*a* is then folded inwardly (if not done previously) to an angle of approximately 90° to form a connecting tab 50. This connecting tab 50 is then connected to the adjacent side panel 36 to complete the perimeter of the octagonal container. Each bottom flap 28 is then moved into position abutting against its adjacent floor panel 30, as shown in FIG. 1. Each bottom flap 28 is sized to bridge the distance between its respective floor panel 30 and its respective end panel 34 to ensure that each end panel 34 remains in position and to provide structural support for the container 10. The floor panels 30 and the bottom flaps 28 combine to form a base 52 providing rigidity to the container 10 in the use position (FIG. 1**).

If desired, an optional floor member (not shown) of octagonal shape made to fit within the assembled container 10 could be provided or utilized.

To move the container 10 from the use position to a plurality of storage positions, each bottom flap 28 is disengaged from its respective floor panel 30 and pivoted upwardly toward its respective end panel 34. Each end panel 34 and its respective bottom flap 28, now in contiguous alignment, are folded toward the middle of the container 10 along the second series of the transverse fold lines 40. This results in the end panels 34 of the container 10 collapsing toward the middle, which forms the entire container in the position shown in FIG. 2.

The position shown in FIG. 2 illustrates the container 10 having been lifted from the top 14 of the pallet 12 by folding of the third series of the lateral fold lines 44. In this position, the distance between the inner surfaces 46 of the side panels 36 is reduced and the corner panels 38 are now in parallel alignment with their respective side panels 36. To obtain the position shown in FIG. 3, the remainder of the lateral fold lines 44 are folded inwardly.

The second series of lateral fold lines 43 juxtaposed between each respective side panel 36 and the floor panel 30 is foldable in both the inward direction and the outward direction. The third series of lateral fold lines 44 is foldable inwardly to enable the floor panels to be located adjacent the top 14 of the pallet 12 to allow the floor panels 30 to be affixed thereto. The third series of lateral fold lines 44 is foldable in each of two outward directions in order to allow the container 10 to collapse in two different storage positions shown in FIGS. 4 and 5. Depending on which one of the plurality of storage positions is chosen for the container 10, one of the remainder of lateral fold lines 44 is selectively not utilized.

FIG. 3 illustrates the container 10 in its normal distended position prior to being pushed flat into the collapsed storage position parallel to the pallet. FIG. 4 illustrates the container 10 located on the pallet 12 in one of the two possible storage positions, wherein the container 10 is located within the confines of the pallet 12. In this position, the container 10 and pallet 12 may be stored with the likelihood of damage to the container 10 being reduced and the space required for storage of the container 10 being minimized.

While the best mode for carrying out the invention has been described in detail, those familiar with the art to which this invention relates will recognize various alternative designs and embodiments for practicing the invention as defined by the following claims.

What is claimed is:

1. A collapsible container in combination with a pallet, the container comprising:

an octagonal container movable between a collapsed position and a use position, said container formed from two opposed side panels each having a floor panel integrally and foldably connected thereto, two opposed end panels each having a bottom flap integrally and foldably connected thereto, and four corner panels respectively joining said side panels to a respective end panel;

a first lateral fold line separating each said end panel from each said bottom flap, enabling each said bottom flap to selectively pivot between a use position adjacent said pallet in generally perpendicular alignment with each said floor panel and a storage position contiguous with a respective one of said end panels;

each said bottom flap adapted to bridge a distance between its respective end panel and said floor panels in said use position;

a first transverse fold line bisecting each said end panel and its respective bottom flap enabling movement of each said end panel and its respective bottom flap from said storage position to said use position when said respective bottom flap bridges such distance between its respective end panel and said floor panel to oppose movement of said end panels toward said storage position;

a plurality of second transverse fold lines juxtaposed between each said end panels and said side panels, and said side panels and said corner panels enabling formation of the octagonal configuration of said container as said container moves from its storage position to its use position;

a plurality of second lateral fold lines juxtaposed between said side panels and its respective floor panel enabling said floor panels to be oriented adjacent said pallet and affixed thereto when said container is in said use position, said second lateral fold lines being folded to move said container to said storage position; and said floor panels each containing a plurality of third lateral fold lines, said plurality of third lateral fold lines, in combination with said first transverse fold lines, said second transverse fold lines, said first lateral fold lines and said second lateral fold lines, enabling collapsing movement of said container between said use position and said storage position.

2. The collapsible container of claim 1 wherein said container is located substantially within said pallet in both said use position and said storage position.

3. The collapsible container of claim 1 wherein said plurality of third lateral fold lines in combination with said transverse fold lines, said second transverse fold lines, said first lateral fold lines and said second lateral fold lines enables storage of said container in a plurality of storage positions.

4. The collapsible container of claim 3 wherein said plurality of storage positions includes a first storage position generally overlaying said pallet in a first direction and a second storage position generally overlaying said pallet in a second direction.

5. The collapsible container of claim 1 wherein said first transverse fold line and said second transverse fold line are in generally parallel alignment.

6. The collapsible container of claim 1 wherein said first lateral fold line, said plurality of second lateral fold lines and said plurality of third lateral fold lines are in general parallel alignment.

7. The collapsible container of claim 1 wherein said plurality of third lateral fold lines divide said floor panels into three generally equivalent sections.

8. The collapsible container of claim 1 wherein said plurality of second lateral fold lines enables each said side panel to move in a first direction toward its respective floor panel and in a second direction away from its respective floor panel when said floor panel is affixed to said pallet.

9. The collapsible container of claim 1 wherein said plurality of third lateral fold lines enable said floor panel to fold relative itself.

10. The collapsible container of claim 1 wherein said plurality of second transverse fold lines enables said bottom flap to move with its respective end panel when said bottom flap is in said storage position.

* * * * *

UNITED STATES PATENT AND TRADEMARK OFFICE

CERTIFICATE OF CORRECTION

PATENT NO. : 5,542,541

DATED : August 6, 1996

INVENTOR(S) : Smith

It is certified that error appears in the above-identified patent and that said Letters Patent is hereby corrected as shown below:

Column 2, line 22, delete "Nos." and replace with -- No. --;

Column 3, line 20, delete "then" and replace with -- than --;

Column 5, line 32, delete "48";

Column 5, line 47, delete "pallet 10" and replace with -- pallet 12 --.

Signed and Sealed this

Twenty-eighth Day of January, 1997

*Attest:*

Bruce Lehman

BRUCE LEHMAN

*Attesting Officer* *Commissioner of Patents and Trademarks*